United States Patent [19]

Paton et al.

[11] 3,945,818

[45] Mar. 23, 1976

[54] METHOD FOR ELECTROSLAG REMELTING WITH SLAG INTRODUCTION AND CURRENT CIRCUIT

[75] Inventors: Boris Evgenievich Paton, Kiev; Jury Vadimovich Latash, Kiev; Boris Izrailevich Medovar, Kiev; July Georgievich Emelianenko, Kiev; Mikhail Markovich Kljuev, Elektrosal, all of U.S.S.R.

[73] Assignee: Patent Management, Inc., Washington, D.C.

[22] Filed: Nov. 13, 1974

[21] Appl. No.: 523,492

Related U.S. Application Data

[60] Division of Ser. No. 186,765, Oct. 5, 1971, and a continuation-in-part of Ser. Nos. 10,419, Feb. 11, 1970, abandoned, and Ser. No. 10,485, Feb. 11, 1970, abandoned, said Ser. No. 186,765, is a division of Ser. No. 68,661, Sept. 1, 1970, Pat. No. 3,736,124, which is a continuation-in-part of Ser. No. 592,054, Nov. 4, 1966, said Ser. No. 10,419, and Ser. No. 10,485, each is a continuation-in-part of said Ser. No. 592,054.

[30] Foreign Application Priority Data

| | | |
|---|---|---|
| Oct. 25, 1966 | Austria | 9973/66 |
| Mar. 5, 1966 | U.S.S.R. | 1060334 |
| Apr. 2, 1966 | U.S.S.R. | 1067222 |

[52] U.S. Cl. ..... 75/10 R; 13/9 ES; 164/252

[51] Int. Cl.[2].. C22B 4/00; H05B 3/00; B22D 27/02

[58] Field of Search ..... 75/10–12; 164/50, 52, 250, 252; 13/9; 22/57

[56] References Cited

UNITED STATES PATENTS

| | | | |
|---|---|---|---|
| 3,129,473 | 4/1964 | Veil | 22/57 |
| 3,608,618 | 9/1971 | Maskall | 164/252 |
| 3,610,318 | 1/1968 | Simmons | 164/252 |
| 3,842,897 | 10/1974 | Paton | 164/252 |

*Primary Examiner*—Peter D. Rosenberg

*Attorney, Agent, or Firm*—Strauch, Nolan, Neale, Nies & Kurz

[57] ABSTRACT

Molten slag is introduced through the lower portion of a crucible device into the bottom of the remelting zone in an electroslag remelting process using single or plural consumable electrodes in an amount sufficient to achieve a predetermined depth in the remelting zone. The achievement of the predetermined depth is signalled when current flows as a result of the slag level contacting and closing a circuit through an energized electrode disposed in the remelting zone. The crucible has a bottom plate at its lower end, the bottom plate has a recess in its top side and a piece of metal is inserted in the recess to provide electrical contact between the piece of metal and the bottom plate the piece of metal in the recess in the bottom plate is connected by a center tap line to an electric current source which passes through the electrode(s), the slag and the piece of metal during initial remelting.

16 Claims, 9 Drawing Figures

METHOD FOR ELECTROSLAG REMELTING WITH SLAG INTRODUCTION AND CURRENT CIRCUIT

CROSS-REFERENCE TO RELATED APPLICATIONS

This application is a division of application Ser. No. 186,765, filed Oct. 5, 1971, which is a division of application Ser. No. 68,661, filed Sept. 1, 1970, which is now U.S. Pat. No. 3,736,124, which is a continuation-in-part of abandoned application Ser. No. 592,054, entitled "A Method of Electroslag Remelting of Metal and Plant Effecting Same," filed Nov. 4, 1966. Also, this application is a continuation-in-part of Ser. No. 10,419, entitled "Method and Apparatus for Electroslag Remelting of Metals", filed Feb. 11, 1970, now abandoned; and Ser. No. 10,485, entitled "Slag Introduction Method for Electroslag Remelting Process," filed Feb. 11, 1970, also abandoned. These two abandoned applications in turn being continuations-in-part of Ser. No. 592,054.

BACKGROUND OF THE INVENTION

The present invention relates to a method of electroslag remelting of metal from consumable electrode means, and particularly to electroslag remelting utilizing introduction of molten slag at the bottom of a crucible device.

In the electroslag remelting of metals, a bath of molten is obtained in a remelting zone, for example, a crucible or a mold (often referred to as a crystallizer). At least one consumable electrode is disposed to extend into that zone with its lowermost end immersed in said molten slag bath. Electric current is caused to flow from the electrode to and through the slag bath. The passage of the current through the slag bath produces heat which causes the electrode to melt. As the electrode melts, the remainder of the electrode is lowered into the slag bath so that all of the electrode is progressively melted. Because the metal in the electrode has a density greater than that of the slag bath, a molten pool of metal is formed below the slag bath. This molten pool of metal progressively solidifies into an ingot of refined metal.

Known in the prior art are methods of electroslag remelting of metal, obtained from consumable electrodes in a cooled crucible, disposed on a bottom plate; for carrying out the remelting process, a pool of molten slag is formed in said crucible.

The molten slag pool is obtained in the crucible in one case due to the melting of a solid flux or a mixture of its charge constituents during the remelting of a consumable electrode directly in the crucible. In another case, non-consumable electrodes, carbon or graphite, are employed for these purposes. This method is known as the "dry start" method.

There is also employed a flux premelted in a separate unit or a mixture of its charge constituents, followed by top pouring the molten slag thus obtained into the crucible. This method is referred to herein as "top pouring."

In the first two cases of preparing the molten slag pool, the time as required for obtaining an ingot is increased by as much as 10 to 20 percent, since the melting of slag is carried out directly in the crucible, which is likely to decrease the production rate of the plant by as much as 10 to 20 percent.

Besides, when preparing the molten slag pool with the use of consumable electrodes, there occurs an incomplete melting of the flux in the peripheral zone of the crucible which is likely to drastically impair the surface of the ingot being melted and to increase the bottom discard to be cropped during the subsequent processing of the ingot up to 10 percent.

Through the preparation of the molten slag pool in the crucible by top pouring therein the molten slag is a progressive method, which allows increasing the production rate of the plant and ensuring a high quality of the bottom part of the ingot, this method possesses its disadvantages, too.

When placing the consumable electrode in the crucible, the gap therebetween is small, and the pouring of the molten slag therein presents difficulties. The molten slag gets on the crucible walls and consumable electrode, and is likely to produce slag sows or lumps thereon. The falling off of the slag sows into the slag pool during the melting process may result in marked variations of electrical conditions of the melting process.

To eliminate said disadvantages requires that during the pouring of the molten slag the consumable electrode should be outside the crucible, for which reason the design of the plant must provide for lifting the electrode clamped in the electrode holder over the crucible so that the latter could be displaced from under the electrode for pouring the slag therein.

The short electric circuit is elongated thereby, and consequently, the losses of active energy increase therein, too, which results in a reduction of the power factor of the plant (cosl). After top pouring the molten slag into the crucible, a voltage is applied to the installation, and the consumable electrode is lowered at a maximum speed into the crucible until it is brought into contact with the slag. During this time, a crust or lining of the solid slag may form on the crucible walls and on the cooled bottom plate or a dummy bar, if it is to be placed on the bottom plate, which crust is likely to insulate the molten slag pool from the bottom plate and crucible, which results in a breaking occurring in the current circuit, and the melting process may not start.

Disadvantages of the existing plants employed for effecting the electroslag remelting of metal according to said method, consist in their excessive height, which is connected with a necessity of pouring the molten slag with the consumable electrode being raised, and with considerable losses of time as required for effecting auxiliary operations. Besides, there are required dummy bars or sacrificial plates for protecting the bottom plate against the burning through.

SUMMARY OF THE INVENTION

In conformity with the present invention, the molten slag pool is produced in the crucible by pouring the molten slag into its bottom part, in other words, its lower portion. The consumable electrode (or electrodes) is inserted into the crucible until its lower end is at a predetermined distance from the bottom plate, and a voltage is applied to the plant simultaneously with the pouring of slag into the bottom portion of the crucible. When the level of slag in the crucible reaches the electrode, there occurs the completion (closing) of the electric circuit of the plant, and the process of remelting the consumable electrode begins.

Because of a rapid rising of the slag level in the crucible, there is insufficient time for a crust or lining of solidified slag to form on the bottom plate (or dummy bar) and on the crucible walls, and current begins to flow in the electric circuit of the plant, while the pouring of the molten slag continues to be carried out while current flows, the pouring of slag being discontinued only after the formation of the molten slag pool of a specified depth.

According to the present invention, in the plant for carrying out the method, said plant being provided with an electrode holder complete with consumable electrodes that are disposed in a crucible placed on a bottom plate, in the lower part or portion of said plant there is disposed a pouring device for supplying the molten slag into the crucible through a channel (access port). The access port or channel for introduction of the slag can be constructed in many ways such as a bore or aperture adjacent the lower portion of the crucible through the crucible wall or through the crucible bottom plate. For convenience in cleaning out solidified slag in the channel such channel can be made separable, e.g., it can be formed by the linking of the bottom plate with the crucible.

In one embodiment of the realization of the present invention, the channel, through which the pouring device communicates with the crucible, is formed by an external boring (elongated recess) in the bottom plate, covered from above by the end surfaces of the crucible wall and syphon pouring device.

In another embodiment of the invention, the channel or passage for supplying the molten slag is formed in the lower end portion of the crucible wall by a radial boring or groove, covered from below by the bottom plate of the crucible.

The channel or passage for supplying the molten slag may be also formed by two borings or grooves facing each other, said borings or grooves being located in the lower end portion of the crucible wall and in and to the outside of the bottom plate of the crucible, respectively.

It is expedient to design the pouring device detachable along the longitudinal plane of its channel.

The engineering solutions set forth herein allow manufacturing a plant for electroslag remelting of metal, said plant being simple in operation and design.

In the startup of electroslag remelting furnaces, it is commonplace to use a high conductivity starter plate such as a copper plate on the crucible base plate for the purpose of obtaining an adequate electrical connection. However, considerable difficulty has been experienced with such plates primarily due to uneven or unequal electrical contact between the overall area of the plate and the crucible base plate. According to a feature of this invention, it is possible to dispose with such a starter plate if the base plate is provided with a recess in which a piece of metal of the same composition as the ingot is fitted. This piece of metal is referred to as a weld lug. The weld lug extends up above the top surface of the base plate and sideways pressure is exerted against the bottom of the lug in the recess to press it firmly against the bottom plate. When remelting begins in the molten slag bath, the top of the weld lug extending into the bottom of the mold will melt and weld to the ingot. Thus, excellent electrical contact will be obtained between the base plate and the ingot.

In accordance with another embodiment of the present invention, molten slag is poured into the mold through the bottom thereof as described above. However, instead of applying power between the electrode and the bottom of the mold, power is applied between at least two electrodes which are fed simultaneously as a unit into the mold as the electrodes melt. The power applied between the electrodes causes current to flow between the elecrodes through the molten slag thus heating the slag and melting the electrodes. This technique of energizing the electrodes and supplying heat to the molten slag greatly reduces the inductance of the system because the leads supplying power to the system can be and are maintained close together. As a result, the power factor of the system is made considerably higher. Because the power factor is higher, much less power is required to produce a given size ingot and a much lower capacity transformer may be used to produce a given size ingot. When a single electrode is used, the application of electrical power between the electrode and bottom plate during pouring results in the liquid slag being electrically connected directly to one side of the power source. In the system of the present invention wherein the power is applied between two electrodes, this hazard is eliminated.

In conjunction with the foregoing discussion, an object of the present invention is to provide unique methods of electroslag remelting which eliminate disadvantages of previously known methods and plants for carrying into effect same. This object is achieved by providing a novel method of supplying molten slag to a remelting zone whereby the above described disadvantages are overcome or minimized.

It is a further object of the present invention to provide a novel method of slag pouring which gives significantly improved results.

These objects are realized by the application of a method of electroslag remelting of metal as discussed in the foregoing Summary, where pouring of molten slag into the crucible is effected in such a manner as to eliminate the possibility of the breaking of the current circuit of an electroslag remelting plant or apparatus, which would be adapted for carrying into effect the pouring of the molten slag in such a manner.

DESCRIPTION OF THE DRAWINGS

The nature of the present invention will further become more fully apparent from a consideration of the following description of an exemplary embodiment thereof, taken in conjunction with the acompanying drawings, in which.

Figure 1:
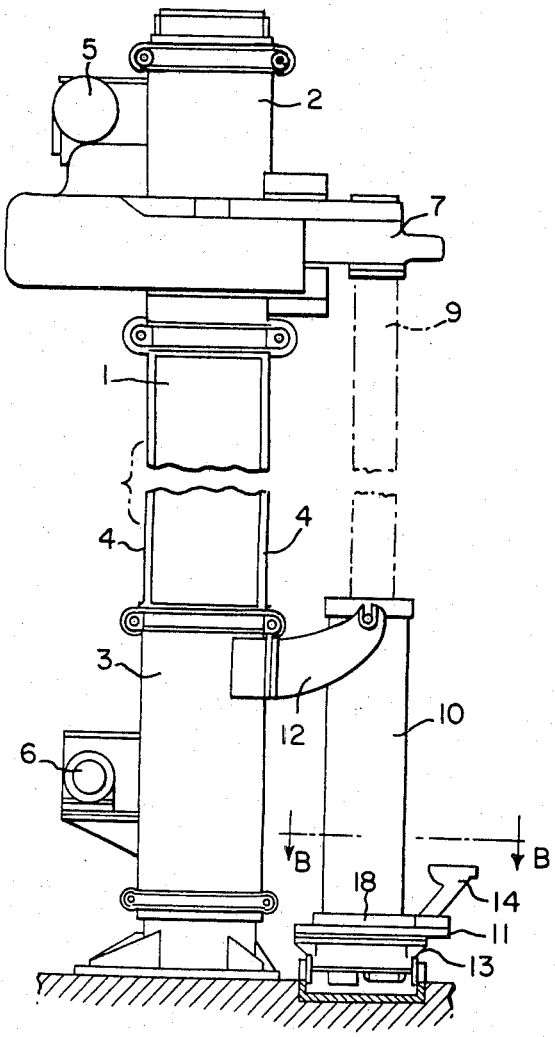
FIG. 1 is a general side elevation view of a plant for electroslag remelting of metal according to the present invention.

The proposed plant for electroslag remelting of metal has a supporting column 1 (FIGS. 1 and 2) complete with carriages 2 and 3 disposed thereon, said carriages being displaced progressively relative to columns 1 along guides 4 by the aid of drives 5 and 6.

Attached to the carriage 2 is an electrode holder 7 of the clamp type complete with a drive 8, designed to secure a consumable electrode 9 moving relative to a crucible 10 during the progressive motion of the carriage 2.

The crucible part 10, to be placed on its bottom plate 11, is connected by a bracket 12 to the carriage 3 and during the displacement thereof it can rise relative to the bottom plate 11, placed, in its turn, on a carriage 13.

In the lower part of the plant, there is provided a pouring device 14, communicating with the crucible 10 and intended for supplying therein the molten slag which is premelted in a separate unit, for example, in an arc furnace.

The pouring device 14 communicates with the crucible 10 through a channel or passage 15 (FIGS. 3 and 4) which terminates in an access port, as formed by the linking of the bottom plate 11 with the crucible 10. Thus, in the FIG. 3 embodiment the channel 15 has boundaries determined by the top surface of bottom plate 11 and the end surface of the sidewalls of crucible 10.

Figure 3:
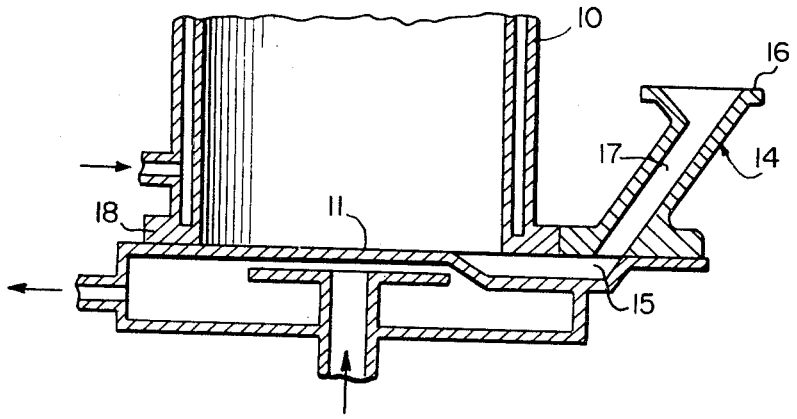
FIG. 3 is a vertical section detail view of the plant taken along the line A—A of FIG. 2 showing structural details of one embodiment of the bottom pouring device.
Figure 4:
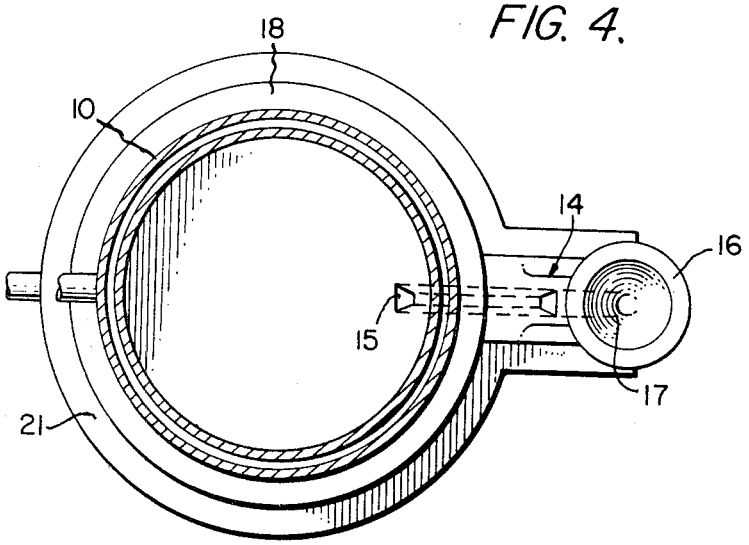
FIG. 4 is a cross-section view, taken along line B—B of FIG. 1.

In the exemplary, preferred embodiment of the present invention, represented in FIGS. 3 and 4, the access port in channel 15 is formed by an external boring or aperture provided in the bottom plate 11, and is covered from above by the lower end surfaces of the crucible 10 and pouring device 14. This channel 15 has its upper surface determined by the lower end surfaces of crucible 10 and pouring device 14 and its lower surface determined by an extension of bottom plate 11.

To facilitate the removal of slag after the completion of melting, it is desirable that the boring provided in the bottom plate 11 should have in its cross section a trapezoidal or segment-shaped form. That is, for ease of removal of the slag from channel 15 after completion of remelting, it is desirable that the longitudinal and transverse cross section of the channel should be trapezoidal or segment shaped, as is apparent in FIGS. 3 and 4.

The channel or passage 15 into the lower portion of the crucible may be formed by a radial boring or aperture (which is not shown in the drawing) provided on the lower end of the crucible 10 and covered from below by the bottom plate 11 or by borings or grooves (not shown in the drawing) provided on the lower end of the crucible 10 and the bottom plate 11 facing each other. The access into the crucible can also be formed by spaced apart apertures (not shown in the drawing), in one or the other or both of the bottom plate 11 and the sidewall of crucible 10. All these embodiments of the channel provide for a rapid access thereto for cleaning it from the slag after the completion of the melting process.

The pouring device 14 is provided in its upper part with a receiving funnel 16, which may be made as a single piece integral with it or detachable therefrom. It is expedient to make the pouring device 14 detachable along the plane of its channel 17, if the cleaning operation is to be effected immediately after the pouring of the molten slag into the crucible 10. The pouring device 14 may be made non-detachable, if the cleaning of the channel 17 from the slag is effected after the completion of the melting process; in this case, however, the channel 17 should have a slight taper, as seen in FIG. 5, for instance, from 1 to 3 percent, with the big end down.

The top end of receiving funnel 16 ordinarily is at a distance above bottom plate 11 sufficient to insure an adequate head of slag in funnel 16 so that the slag reaches its predetermined depth inside crucible 10 and contacts the lowermost end of electrode 9. It is desirable that the lateral end of the pouring device 14 should repeat the shape of the lateral surface of the lower flange 18 of the crucible 10. The pouring device 14 may be fastened to the lower part of the crucible 10 or to the bottom plate 11, and may be made of metal or with a lining of the internal channel 17 and receiving funnel 16. Thus, when pouring device 14 has the same shape as flange 18 of the crucible 10, the pouring device 14 can be fastened to the flange 18 of crucible 10 or to bottom plate 11 or to both flange 18 and plate 11.

Figure 5:
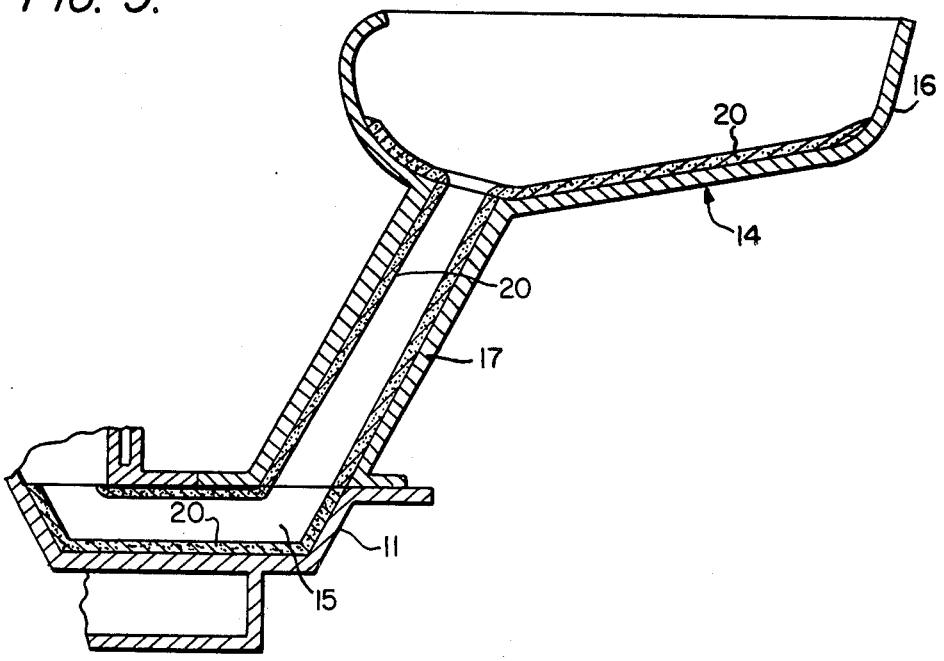
FIG. 5 is a vertical section view of a second embodiment of a bottom pouring device according to the present invention.

Since the pouring device 14 can be made of metal, part or all of the inside of channel 17, receiving funnel 16 and channel 15 can be lined as at 20 in FIG. 5, to resist heat.

If desired, heating elements (not shown) can be placed on the receiving funnel 16 and/or channel 17 in order to maintain or to increase the temperature of the molten slag as it flows therethrough.

Apart from the described component members, the plant or apparatus is also provided with a system for supplying a cooling liquid to the crucible 10 and bottom plate 11; a system for electric supply (a transformer, bus bars, and flexible cables); a system for exhausting gases evolving from the crucible during the melting process; apparatus for controlling and adjusting the melting operation, that are not described here in detail as being not relevant to the essence of the present invention.

The proposed installation operates as follows.

The consumble electrode 9 (or electrodes) is introduced into the electrode holder 7 and is clamped there by the aid of drive 8. Then, due to a displacement of the carriage 2, the electrode 7 is adjusted down into the crucible so that its lower end is disposed at a distance from the bottom plate 11 somewhat smaller than the thickness of layer of the molten slag to be poured into the crucible 10. Hence, when the layer of slag in the crucible is equal to, for example, 200 mm, the lower end of the electrode 9 should be spaced from the bottom plate 11 at a distance of 190 mm.

The voltage is applied to the crucible by switching in the transformer.

The molten slag is poured from a ladle into the receiving funnel 16 of the pouring device 14, and is supplied into the crucible 10 through channels 17 and 15. The pouring of the slag is discontinued at the moment the level of the molten slag in the crucible reaches the lower end of the electrode 9, which is evidenced by the current flowing through the plant circuit.

Thereupon, desirable electrical conditions of the melting process are preset by the aid of an appropriate apparatus, said electrical conditions being maintained constant throughout the melting process involving the building up of the ingot, or may vary according to the present program, which is effected due to a variation in the speed of feeding the electrode 9 by adjusting the rotational speed of the drive 5, and to a variation of the voltage of the secondary winding of the transformer intended to supply the plant. Thus, as pointed out above, the electrode is lowered to a depth of immersion to obtain the desired current flow to maintain the desired slag temperature. As the electrode melts, it is fed into the mold to maintain the end of the electrode immersed in the molten slag.

The ingot of a required height having been built up in the crucible 10, the melting process is discontinued, for which purpose feeding of the electrode is stopped, the transformer switched off, and the carriage 2 then raised into its upper position. The remaining stub of the electrode 9 is thereafter removed form the electrode holder 7. Thereupon, the crucible part 10 is raised by the aid of the carriage 3 until the built-up ingot is made to leave it completely, whereupon the carriage 13 complete with the bottom plate 11 and ingot are rolled out aside from the crucible part 10. The ingot is then removed and the channels 15 and 17 are cleaned from the solidified slag. Sometimes, with a view of saving time, the pouring device 14 is to be cleaned from the slag in the course of the melting process.

Subsequently, carriage 13 together with the bottom plate 11 is again placed under the crucible part 10, which is lowered onto the bottom plate. The pouring device 14 is connected thereto, and the working procedure as described above is repeated.

The proposed plant may be made use of to manufacture ingots of a round, oval, square, rectangular or any other cross secton depending upon the crucible shape.

The method and plant, realized according to the present invention, provide for a maximum possible coefficient of utilization of the working time; allow obtaining ingots with the bottom portion thereof of a high quality, which permits practically to avoid cropping the bottom discard; facilitate the rapid performance of the operation of pouring the molten slag into the crucible and the preparation of the plant before starting the subsequent melting process. The greater the weight of the ingot being formed, the greater is the efficiency of the instant apparatus.

The proposed plant is of a comparatively small height.

Aside from the above-mentioned advantages, the proposed plant provides for carrying out the process of electroslag remelting without the use of metallic dummy bars that are to be placed in the existing units on the bottom plate with a view of preventing its damage during the beginning of the melting process.

Figure 6:
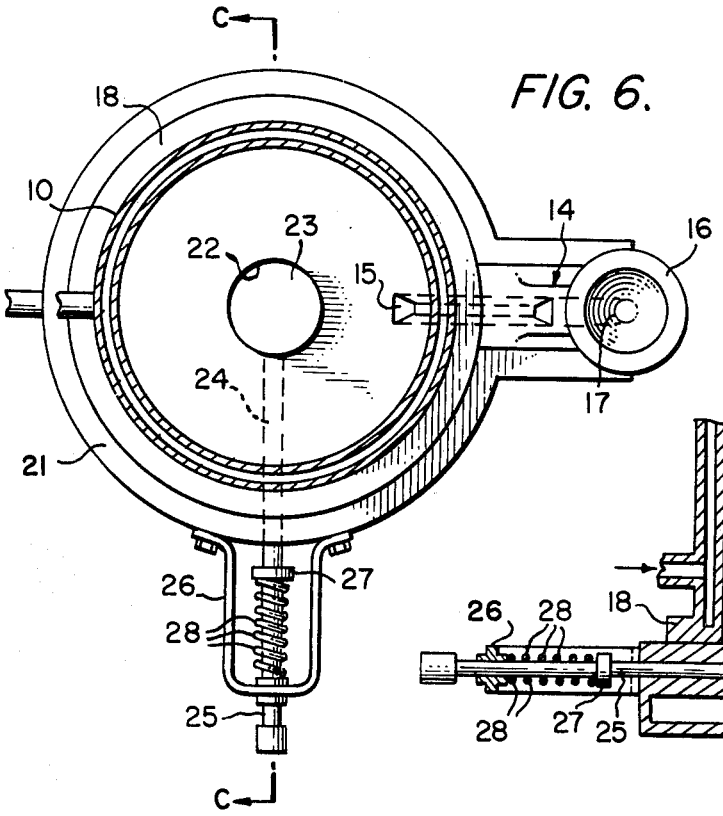
FIG. 6 is a cross-section view showing the bottom of a furnace similar to that illustrated in FIG. 4 and shows the use of a weld lug.

The utilization of the proposed plant proves to be more efficient the greater the weight of ingots that are to be made therein. It is also possible to employ one or a plurality of the consumable electrodes for obtaining an ingot. Thus, one or a plurality of the consumable electrodes clamped together without insulation between and with power applied between electrodes and the bottom plate can be employed to obtain an ingot. Other electrical arrangements can be used when a plurality of electrodes are employed such as designing the circuitry so that the applied electric current flows between the ends of the electrodes when they are in contact with the molten slag rather than from the electrodes to the bottom plate. In such an arrangement the current can be caused to flow between two or four electrodes as shown in FIGS. 5 and 6 of Belgian Pat. No. 670,299 or between three electrodes as shown in FIG. 4 of British Pat. No. 979,583 wherein a three phase transformer is used for the electrical supply.

Referring to the access port of channel 15 as above described, this access port and the radial cross section of channel 15 ordinarily have the same area. These areas ordinarily range from 6 to 120 sq. cm. for circular ingots of 65–1500 mm diameter (or equivalent non-round cross sections). The use of these cross sections assures that the back pressure in channel 15 will not be excessive and that slag will solidify in channel 15 blocking backflow through the access port from the crucible and the remelting proceeds.

The above-described lining of the internal channel 17 and receiving funnel 16, if desired, can be extended into channel 15, using shields 20 of refractory material such as graphite as shown in FIG. 5, to prevent the molten flux from burning through the funnel wall. The graphite shields may be 8–10 mm in thickness in a typical installation.

When electrode 9, (see FIG. 1), is clamped in electrode holder 7, it is adjustably lowered by means of carriage 2 so that its lower portion moves into the crucible 10 until its lowermost end is spaced above the bottom plate 11 a distance from 4% to 20% less than the thickness (that is, the depth) of the layer of the molten slag to be poured into crucible 10.

Figure 7:
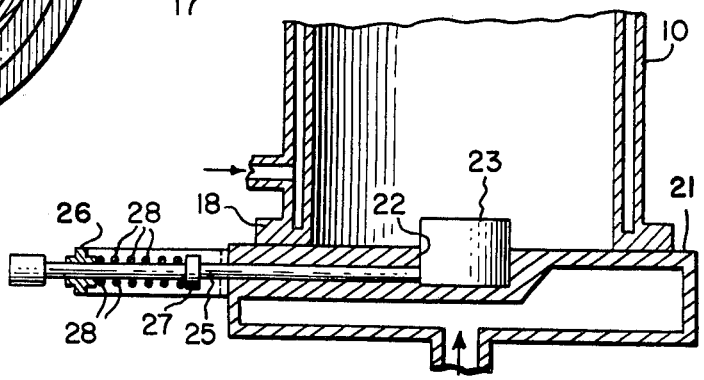
FIG. 7 is a vertical section taken along line C—C of FIG. 6 showing details of the device for clamping the welding lug.

Illustrated in FIGS. 6 and 7, there is an exemplary use of a weld lug. To provide a perfect electrical connection between the ingot being formed in the mold and the bottom plate 21, a circular recess 22 is provided extending down into the bottom plate 21 from its top surface which forms the bottom of the mold. A circular piece of metal 23 of the same composition as the ingot which is to be formed in the mold by the electroslag remelting process is fitted in recess 22. FIG. 6 shows a pouring device 14 with a receiving funnel 16 and a connecting channel 17 attached to the mold 10 in a manner similar to that hereinbefore described for FIG. 4.

A cylindrical passage or bore 24 is defined in the bottom plate 21 extending horizontally from recess 22 to the outer side of the wall of bottom plate 21. Cylindrical passage 24 slidably mounts a spring biased clamp pin 25, the inner end of which engages the weld lug 23. The outer end of pin 25 is slidably guided through a U-shaped bracket 26 mounted on the sidewall of bottom plate 21. Pin 25 is provided with an abutment collar 27 on the portion disposed between bracket 26 and the bottom plate sidewall. A coil compression spring 28 surrounds the pin 25 between the collar 27 and the U-shaped bracket 26 and applies a force against the collar 27 which urges the pin 25 against the weld lug 23 which presses the weld lug 23 against the side of the recess 22. In this manner an excellent electrical contact is obtained between the weld lug 23 and the bottom plate 21. When the molten slag bath is first introduced into the mold, the heat of the molten slag will cause the top of the weld lug 23 extending up into the mold to melt and the molten pool, which is initially formed in the bottom of the mold, will come in contact with the melted upper portion of the weld lug. As a result, when the ingot starts to solidify, weld lug 23 will be welded to the bottom solidified portion of the ingot being formed and an excellent electrical contact will be obtained between the weld lug and the ingot and thus between the ingot and the bottom plate 21.

Figure 8:
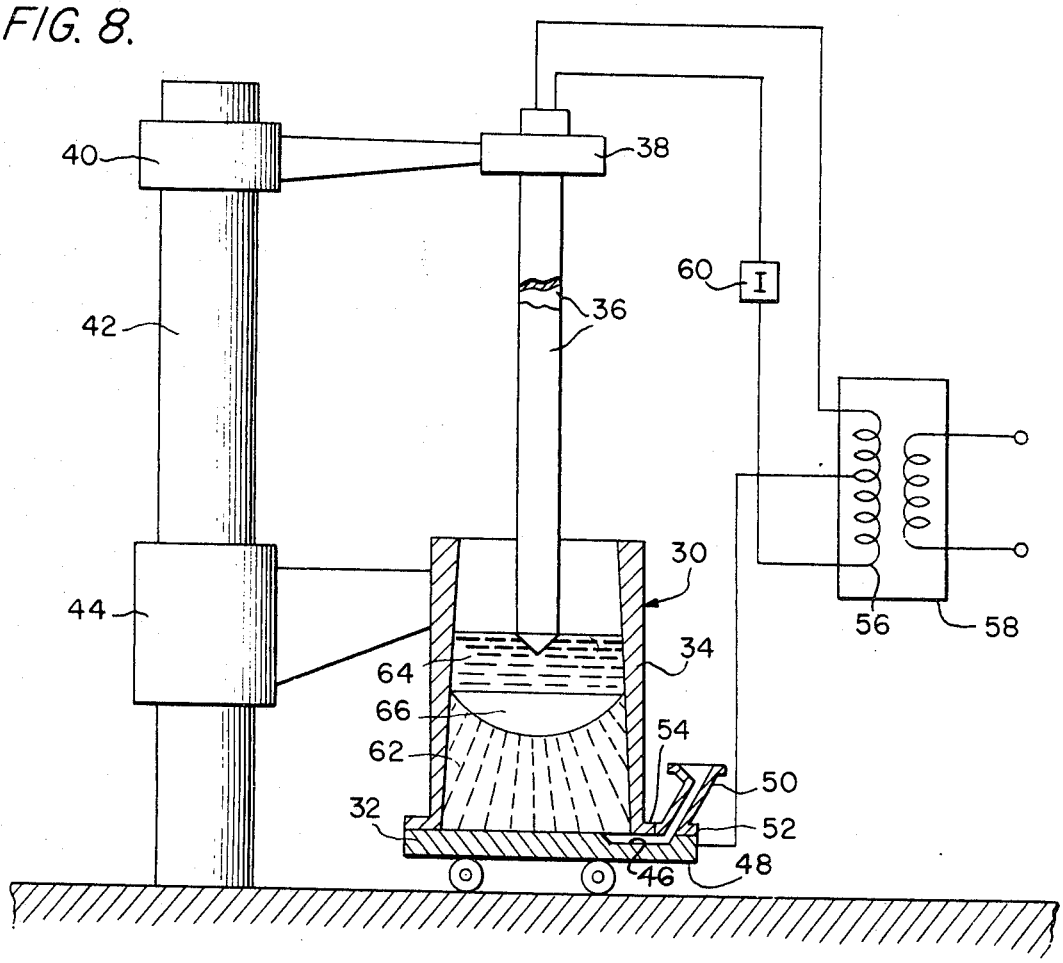
FIG. 8 is an elevation view partially in section schematically illustrating the system of the present invention as applied to a bifilar furnace.
Figure 9:
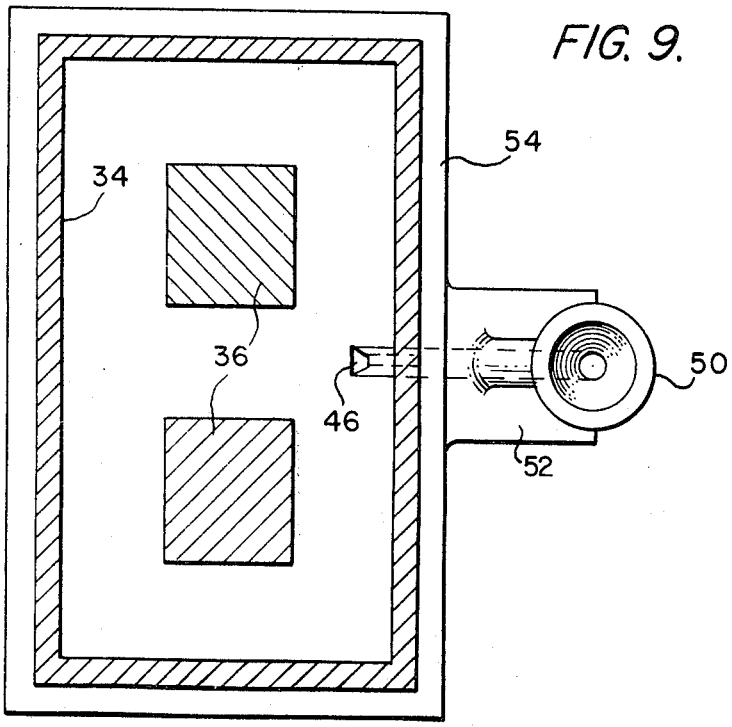
FIG. 9 is a sectional view taken horizontally through the mold shown in FIG. 8, illustrating the spaced apart arrangement of the electrodes in the mold.

In an embodiment illustrated in FIGS. 8 and 9, a system in accord with the present invention may comprise a mold 30 including a bottom plate 32 and sidewalls 34. Although not shown in FIGS. 8 and 9, mold 30 is water cooled by conventional techniques, such as has been hereinbefore described. A pair of electrodes 36 are positioned over the mold 30 extending down into the open top of the mold. The electrodes are supported by an electrode holder 38 mounted on a carriage 40. Carriage 40 can be moved up and down a supporting tower 42 to feed the electrodes 36 together as a unit into the mold 30 as the electrodes melt. The sidewalls 34 of the mold are mounted on a second carriage 44 which also is movable up and down the tower 42. Drive motors, similar to drives 5 and 6 in FIG. 1 can provide the motive force for the carriage 40 and 44.

As can be seen in FIG. 9, a channel 46 is defined by a groove in the top surface of the bottom plate 32 extending from inside of the mold sidewalls to outside thereof and extending into a tongue 48 formed on the bottom plate. The channel 46 is preferably positioned as shown in FIG. 9 at a point half way between the two electrodes. A funnel 50 provided with a base plate 52 reset on the tongue 48 of the bottom plate and closes the top of the portion of the channel 46 which extends out into the tongue 48. The sidewalls are formed with a flange 54 which abuts against the plate 52 so that the portion of the channel 46 extending outside of the sidewalls 34 is completely covered. The passage of funnel 50 connects with the channel 46. As a result, a closed channel is provided between the bottom of the interior of the mold and the mouth of the funnel 50.

Each of the two electrodes 36 is connected to an opposite side of the secondary winding 56 of the transformer 58. The seconding winding has a center tap to which the mold bottom plate 32 is connected, preferably by means of a weld lug as hereinbefore described, but not shown in this embodiment. In operation, the assembly of electrodes 36 is first lowered into the mold 30 to a position determined by the desired depth of the bath of molten slag to be formed in the mold. AC power is applied between the electrodes from the transformer 58. Then superheated molten slag is poured into the bottom of the mold 30 through the funnel 50 and the channel 46. When the molten slag in the mold 30 reaches a depth sufficient to contact the two electrodes 36, current will begin to flow between the electrodes through the molten slag thus heating the molten slag and beginning to melt the electrodes 36. This flow of current will be indicated by an indicator 60, which for example may be an ammeter connected in the conductor between one of the electrodes and the transformer 58. When the technician who is controlling the pouring of the molten slag into the mold observes that current begins to flow through the electrodes 36 as indicated by the indicator 60, he immediately stops pouring the molten slag. In this manner, by initially positioning the electrode at the proper depth in the mold, the desired amount of molten slag in the mold is readily obtained with precision. Because there will be some reaction time between the indication provided by indicator 60 and time pouring of slag actually stops, the slag will be poured to a depth a little above the ends of the electrodes in the mold. The desired amount of slag is nevertheless precisely obtained by initially positioning the bottom ends of the electrodes just below the desired level of slag in the mold.

As the electrodes 36 are melted, they are fed into the molten slag by the carriage 40 moving on the tower 42 to maintain the electrodes immersed at the desired depth in the molten slag. As the electrodes melt, they will form a molten pool beneath the bath of molten slag which will solidify into an ingot starting from the bottom of the mold with a pool of molten metal being maintained between the bath of molten slag and the solidified ingot. In FIG. 8, the solidified ingot in the mold is designated by the reference number 62, the bath of molten slag is designated by the reference number 64, and the pool of molten metal is designated by the reference number 66. The connection between the bottom plate 32 and the center tap of the secondary winding 56 serves to maintain the melting rates of the two electrodes equal. Should one of the electrodes melt slower than the other it will become more deeply immersed in the molten slag. The resistance between this electrode and the bottom plate 32 will be reduced relative to that between the other electrode and the bottom plate. As a result, some current will flow between the center tap and the more deeply immersed electrode, thus increasing the current flow through the more deeply immersed electrode relative to the other electrode. This action results in the more deeply immersed electrode melting at a greater rate until its immersion becomes less, the current decreases and melting rate decreases. In this manner, the melting rates of the electrodes tend to equalize. As the ingot is formed, the bath of molten slag will rise in the mold 30. When the bath nears the top of the mold, the melting of the electrodes is ended and the molten pool of metal at the top of the ingot and the bath of molten slag is allowed to solidify. After the solidification has taken place, the sidewalls 34 are stripped from the ingot by moving the carriage 44 up on the tower 42. The sidewalls 34 are conical shaped with the large end down as shown in FIG. 8 to facilitate stripping.

In this manner, a high quality ingot is produced by an electroslag remelting system with a relatively high power factor. The ingot can be produced by remelting of ferrous or nonferrous metals from the consumable electrodes.

The "dry start" method of obtaining a molten slag bath, mentioned above as prior art, is time consuming and increases the time for producing finished product ingots by as much as 20% compared to the time required when the slag is melted outside of the remelting zone. In addition, the dry start method has the disadvantage that the afore-mentioned arcing leads to oxygen release from the slag whereby the first portion of the metal melted from an electrode is out of specification. Furthermore, such arcing ordinarily does not melt the slag at the periphery of the remelting zone and as a result the heat produced by the current passing through the slag at the beginning of the remelting process is not sufficient to adequately refine the metal being produced. As a result of the oxygen contamination and as a result of the initial incomplete slag melting, the bottom portion of the formed ingot is of inferior quality and is ordinarily trimmed or cropped from the rest of the ingot and reprocessed or discarded. This bottom portion can amount to up to 10% of the entire ingot.

The prior art "top pouring" method overcomes the aforementioned disadvantages of the "dry start" method but has disadvantages of its own as follows.

If top pouring is carried out with the electrode removed from the remelting zone, a crust of molten slag is often formed at the bottom of the remelting zone during the time the electrode is being lowered into the zone after pouring has been completed. This crust insulates the bottom of the remelting zone so as to block current flow whereby the electroslag remelting process is prevented from starting. When this occurs, the crust-containing slag must be removed from the remelting zone and a new batch of slag poured. This phenomenon is referred to as a false start.

Moreover, if the apparatus is designed so that the electrode can be positioned above the remelting zone, the apparatus is required to be of greater height than otherwise, requiring more factory space, and the lead attached to the electrode is required to be longer whereby inductance is increased so that the power factor is lowered requiring more power per pound of metal produced.

If top pouring is carried out with the electrode in place in the remelting zone, then a long electrode of small cross-section must be used in order to provide a sufficient gap between the electrode and the sidewalls of the remelting zone so that the slag stream does not contact and coat either the electrode or the walls with a scale of solid slag. Moreover, such scale falls in solid form into the molten slag during the remelting process and either can cause marked variation in the current applied during remelting thereby causing non-uniform results or else can be trapped within the metal melted from the electrode so as to form undesirable inclusions in the formed ingot.

The length of the electrode utilized in this method results in high inductance and a lower power factor thereby raising production costs. In addition, a tall tower must be provided for supporting and feeding the electrode. Such a tower adds significantly to the cost of the installation.

In order to ensure that the slag being top poured does not contact either the electrode or the remelting zone walls, the pouring stream must be of relatively small cross-section. As a result, pouring of the slag to a required depth in the remelting zone takes a significant amount of time so that often a crust of solidified slag forms at the bottom of the remelting zone whereby a false start occurs.

Both of the aforementioned techniques of top pouring have the disadvantage that the slag during pouring reacts with nitrogen in the air to form nitrides which dissolve in the metal being produced lowering the quality of the finished product ingot. In addition, moisture in the air dissolves in the slag during pouring and disassociates into hydrogen and oxygen which dissolve in the metal being produced; the hydrogen causes cracking to occur in the finished product ingot. These chemical reactions are encouraged due to the long period of time during which top pouring is carried out and by the large surface area of slag presented during pouring.

Both of the aforementioned techniques of top pouring are dangerous. The fact that the ladle from which the molten slag is poured during top pouring is in an elevated position presents considerable danger to personnel in case of accidental spilling. Moreover, energizing of the electrode can result in a small explosion due to short circuiting causing excess heating of the slag which explosion can upset the ladle if it is still in position over the remelting zone.

Furthermore, top pouring techniques have the very important disadvantage that the electrode cannot be energized previous to the completion of pouring. In top pouring with the electrode outside the remelting zone, the electrode cannot be energized previous to its insertion into the remelting zone for reasons of safety. In top pouring with the electrode in place, depending into the mold, the electrode or electrodes cannot be energized because slag splashing against them during pouring causes short circuiting resulting in explosion. Energizing of the electrode current circuit previous to the completion of pouring would result in a significant time savings so that the apparatus can be used more efficiently.

In addition to the foregoing, top pouring techniques have the disadvantage of requiring special measuring equipment to determine the slag level in the remelting zone at any particular time during top pouring.

As stated hereinbefore under the "Summary of the Invention," the slag pool is produced by pouring the molten slag into the bottom part of the crucible 10. This bottom part of the crucible, as defined by the crucible sidewalls and its separate bottom plate 11, forms a remelting zone in which the electrode or electrodes, such as shown in the embodiment of FIG. 8, are melted by the electrical current as soon as the slag reaches its predetermined depth by rising to contact the electrode (2). The pouring is sufficiently fast and current flow begins sufficiently quickly after the pouring is started that the formation of a slag crust on the bottom of the remelting zone is prevented and thus false starts are eliminated. In fact, the time required for obtaining molten slag in the remelting zone with an energized electrode in place is minimized to a matter of a few minutes or less.

Because the electrode is already in place and because bottom pouring avoids pouring slag past the electrode, the gap between the electrode and the remelting zone walls, i.e., the sidewalls of the crucible, can be made very small thus permitting a large diameter electrode to be used. As a result, a significantly shorter electrode can be used and the height of the tower required is accordingly reduced. With shorter electrodes, the inductance of the circuit is reduced and the power factor of the system is accordingly increased. Since the slag is poured into the bottom of the remelting zone, the possibility of formation of slag scale on the remelting zone walls is entirely eliminated.

With this technique of pouring the molten slag into the bottom of the remelting zone, the operator controlling the pouring can determine very precisely when to stop pouring the molten slag. When the molten slag reaches the electrode, current begins to flow in the electrode and that current flow provides a condition indicating to the operator that the slag bath has reached the predetermined depth. Accordingly, pouring of the slag is discontinued when current starts to flow through the electrode. Because the slag can be poured quickly through a closed channel into the bottom of the remelting zone, there is little opportunity for the slag to react with nitrogen in the air or to dissolve moisture from the air. Furthermore, because slag is poured into the bottom of the remelting zone, the ladle is positioned near the base of the furnace thus greatly reducing the danger to personnel.

DETAILED OPERATING PARAMETERS

The initial predetermined distance between the consumable electrode and the bottom plate is essentially the same as the predetermined initial depth which the slag achieves in the remelting zone. These are not exactly the same because slight additional molten slag will enter the remelting zone between the time when the circuit completion is signalled and the time when the discontinuance of the slag pouring is actually implemented. Accordingly, the bottom of the electrode is positioned just below the desired slag level as the molten slag is poured.

The predetermined initial depth of slag in the remelting zone preferably ranges from one-fourth the transverse sectional dimension of the ingot to be formed to twice the transverse sectional dimension of the ingot to be formed. The transverse sectional dimension is: the diameter, if the ingot cross-section is circular; the length of a side, if the ingot cross-section is square; the length of the shortest side, if the ingot cross-section is rectangular; or the length of the shortest dimension across the center of the ingot, if the ingot is any other shape.

If the initial slag depth is less than one-fourth the transverse sectional dimension of the ingot to be formed, arcing can occur whereby electroslag remelting no longer takes place.Ifthe initial slag depth is more than twice the transverse sectional dimension of the ingot to be formed, a crust of solid slag can form interfering with the current flow. As an illustrative example, for a rectangular slab ingot of 9–15 tons whose smallest cross-sectional dimension is 630 mm., the initial slag depth may advantageously be 250 ± 15 mm.

It is desirable that the molten slag be introduced (that is, poured) into the remelting zone at a rate sufficiently fast and under such conditions that no crust of solid slag is formed on the bottom plate in the remelting zone. The rate of slag introduction so that such a crust will not form is dependent upon the amount of slag being utilized which in turn is dependent upon the size of the ingot to be formed. In general, for ingots of circular cross-sections of 65–1500 mm diameter (or rectangular or square ingots of equivalent cross sectional area), slag pouring rates ranging from 5 to 1500 Kg/minute are usually utilized. As an exemplary situation, for 9–15 ton slab ingots having cross sections of 693,000–900,900 square mm, a pour rate of 750 Kg/minute may be advantageously used.

It is desirable that the rate of slag introduction should be sufficient so that the mass of molten slag in the remelting zone at any time has sufficient superheat to remelt any of the previously added slag that has solidified or to prevent any slag from solidifying that has lost its superheat.

It is also desirable in order to prevent crust formation that the slag be introduced under turbulent flow. For the same ingots of 65–1500 mm diameter ingots (or equivalent rectangular or square ingots), such flow should be from 1 to 20 Kg/sq.cm./min.

The achievement of the aforementioned flow rates is aided by the utilization of molten slag superheated to possess a viscosity of no greater than the viscosity of water at the standard reference temperature of 68° F and preferably much less than this viscosity. It is essentially preferred that the slag be superheated to possess a viscosity ranging from 0.1 to 0.5 centipoises. In order to achieve such a viscosity, the slag for the bottom pour is at a temperature at least 100° C higher than its melting point but no higher than 100° C below the boiling point of the slag. For the slags normally used for electroslag remelting such as ANF-6 the acceptable temperature range is approximately 1440° C to 2100° C.

The molten slag is advantageously introduced into the bottom of the remelting zone utilizing a reservoir which interconnects via a closed channel or conduit with the bottom of said remelting zone. The head of slag in the reservoir is utilized to obtain the desired depth of slag in the remelting zone. Thus, the electrode is initially positioned in the remelting zone with its lowermost portion below the top of the reservoir so that the slag can be poured to a level to contact the electrode. Preferably the reservoir extends above the level ultimately desired for the slag so that there will be no overflow of slag from the reservoir. The slag is conveniently introduced into the reservoir utilizing a ladle.

The cross-sectional area of the stream of slag entering the remelting zone, that is the cross-sectional diameter of the conduit interconnecting the reservoir with the bottom of the remelting zone, ranges from 6 to 120 sq. cm. for circular ingots of 65–1500 mm diameter (or the equivalent rectangular or square ingots). With inadequate conduit cross section, the back pressure on the stream being introduced can be so great that introduction rate will ordinarily be too slow and a false start may occur. With excessively large conduit cross sections, slag will not solidify completely in the conduit just previous to the access port where the conduit opens into the remelting zone, in which case metal will enter the conduit producing an ingot with a "side tongue." The channel through which the slag flows in the bottom pour should extend into the crucible or mold a distance equal to 1 to 2 times the channel depth.

Owing to a rapid rising of the slag level in the remelting zone and its superheated condition, a crust is not formed on the bottom plate. This is extremely important with a monophase start in which the circuit path is through the bottom plate.

Once slag pouring is discontinued and remelting has begun, the depth of the immersion of the electrode is increased so as to cover the conical point which is formed on the electrode during remelting and to increase the current flow so as to maintain the desired slag temperature so that proper remelting occurs.

All slag compositions used for electroslag remelting or refining processes can be poured into the crucible according to the present invention. Representative slag compositions are set out in B. I. Medover et al. *Electroslag Remelting*, N64-11419 U.S. Department of Commerce, Office of Technical Services, Joint Publications Research Service on Table 10, page 53.

EXAMPLE

Figure 2:
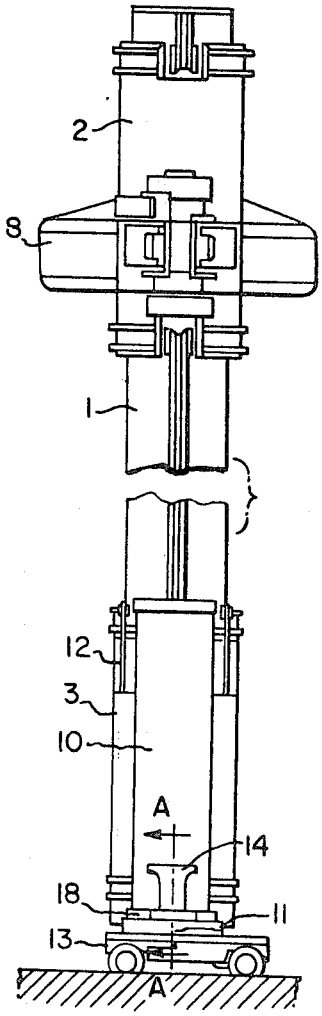
FIG. 2 is a front view of the plant shown in FIG. 1.

The remelting of an electrode to produce a 4 ton ingot was carried out by lowering an electrode into a mold or crucible of 4 ton capacity of the type as shown in FIG. 1. Next, 300 kg. of ANF-6 flux from the above-referred to Table 10 is placed into a heated, carbon-lined crucible ladle and heated by means of nonconsumable carbon electrodes to a temperature of not less than about 1750° C. For this production cycle the diameter of the crucible cavity was about 500 mm and the depth was 800 mm.

Simultaneously with the heating of the slag, cooling water is circulated through the crucible sidewalls and the base plate. The power transformer is then turned on to energize the electrode and the base plate with a voltage of 70 to 90 v. The pouring lip of the crucible ladle is then aligned with the receiving funnel 16 and the ladle tilted to pour the molten slag into the remelting crucible in approximately 0.5 to 1.0 minute. The pouring is terminated immediately upon the appearance of a current, 1 kiloamp, in the transformer electrode line. At such time the level of the molten slag is 5–10 mm above the end of the electrode. The electric current then maintains the temperature of the molten slag and the consumable electrode commences remelting.

The start-up of this remelting process resulted in the absence of arcing of the electric current and the production of an ingot with a fully utilizable bottom portion. There were no start-up or operational disturbances experienced due to slag solidifying onto the electrodes or mold sidewalls as has been the case when the slag is top poured into the mold.

In the preferred embodiment of the present invention, the access port, through which the pouring device communicates with the crucible or mold is formed by an aperture in the bottom plate. The channel communicating with the access port has its top surface defined by a flange extending from the crucible sidewall and an end surface of the pouring device and its bottom surface defined by an extension of said bottom plate.

As stated above, the access port for supplying molten slag is formed by a radial aperture in the crucible sidewall just above the bottom plate. The access port for supplying the molten slag can also be formed by two apertures adjoining each other, one of these apertures being located in the bottom plate and one in the crucible sidewall.

It is expedient to utilize an electrode of sufficient size so that the minimum gap between the electrode and the crucible sidewall is greater than 5 mm and less than 100 mm; this embodiment has the advantage of providing very little air space, thereby minimizing reactions which degrade the ultimate ingot. This embodiment is made feasible by the pouring method and apparatus of the present invention.

The invention may be embodied in other specific form without departing from the scope, spirit or essential characteristics thereof. The present embodiments are therefore to be considered in all respects as illustrative and not restrictive, the scope and spirit of the invention being indicated by the appended claims rather than by the foregoing description, and all changes which come within the meaning and range of equivalency of the claims are therefore intended to be embraced therein.

What is claimed and desired to be secured by Letters Patent is:

1. A method for starting up and supplying electric current to an ESR furnace comprised of a consumable electrode means, a mold, a bottom plate having a recess therein and an electric current source comprising the steps of placing a piece of metal in the recess in the bottom plate, controllably connecting at least the piece of metal and the electrode means to the electric current source, cooling the mold and bottom plate, establishing a molten slag pool in the lower end of the mold, bringing the consumable electrode means and the molten slag pool into contact, supplying electric current from the current source to the furnace for a period of time sufficient to allow the consumable electrode means to be remelted in the slag pool and to progressively resolidify the metal to form an ingot under the slag pool, integrating the piece of metal in the bottom plate recess with the ingot being formed during the initial remelting, and continuing the remelting to form a complete ingot.

2. A method as defined in claim 1, wherein the electrode means comprises a group of at least two electrodes connected to the electric current source, and the piece of metal in the recess in the bottom plate is connected by a center tap line to the current source.

3. A method as defined in claim 1, wherein the molten slag pool is established by bottom pouring the molten slag into the mold through an aperture in the bottom portion of the furnace.

4. A. method as defined in claim 3, wherein the consumable electrode means and the mold are held fixed with respect to one another when the slag and the electrode means are brought into contact with one another.

5. A method as defined in claim 4, wherein the molten slag pool is established by pre-melted molten slag added to the mold through an aperture in the bottom portion of the furnace.

6. A method as defined in claim 3, wherein the piece of metal is in electrical contact with the bottom plate.

7. In a method of electroslag remelting of metal from a consumable electrode means in which at least one consumable metal electrode is disposed with its lowermost end arranged to be in contact with molten slag in a crucible and progressively melted in said slag through the application of electric current, said crucible having a bottom plate at the lower end thereof and the bottom plate having a recess in the top side thereof, and improvement comprising pressing a piece of metal (weld lug) against the side wall of the recess to provide electrical contact between the weld lug and the bottom plate, introducing slag in a molten state into the crucible through at least one passage formed through the crucible adjacent the lower portion thereof, and bringing the consumable electrode means and the molten slag pool into contact to commence the remelting.

8. The method improvement as defined in claim 7, wherein the electrode means comprises a group of at lesat two electrodes connected to the current supply source, and wherein the piece of metal in the recess in the bottom plate is connected by a center tap line to the current source.

9. The method improvement as defined in claim 7, wherein the consumable electrode means and the mold are held fixed with respect to one another when the slag and the electrode means are brought into contact with one another.

10. The method improvement as defined in claim 9, wherein the molten slag pool is established by adding to the mold through an aperture in the bottom portion of the furnace.

11. The method improvement as defined in claim 7, wherein the piece of metal is in electrical contact with the bottom plate.

12. In a method of electroslag remelting of metal from consumable electrodes in which at least one consumable metal electrode with upper and lower ends is disposed with its lowermost end arranged to be immersed in molten slag in crucible means having fluid cooled wall means and progressively melted in said slag through the application of electric current, said crucible means having a fluid cooled bottom plate at the lower end thereof, the bottom plate having a recess therein, the improvement comprising, in the beginning of the remelting process, placing a piece of metal in the recess in the bottom plate, introducing slag in the molten state into the fluid cooled crucible means through at least one port formed through the crucible means adjacent the lower portion thereof, causing the molten slag and the lower end of the consumable electrode to come into contact, and with the electrode in contact with the molten slag, passing electric current through a circuit including the electrode, the molten slag and the piece of metal and integrating the piece of metal with the ingot being formed during initial remelting.

13. The method improvement as defined in claim 12, wherein the electrode means comprises a group of at least two electrodes connected to the current supply source, and wherein the piece of metal in the recess in the bottom plate is connected by a center tap line to the current source.

14. The method improvement as defined in claim 12, wherein the consumable electrode means and the mold are held fixed with respect to one another when the slag and the electrode means are brought into contact with one another.

15. The method improvement as defined in claim 12, wherein the piece of metal is in electrical contact with the bottom plate.

16. The method improvement as defined in claim 12 wherein the piece of metal is pressed against a side wall of the recess to provide electrical contact between the piece of metal and the bottom plate.

* * * * *

UNITED STATES PATENT OFFICE

CERTIFICATE OF CORRECTION

Patent No. 3,945,818 Dated March 23, 1976

Inventor(s) BORIS EVGENIEVICH PATON etal

It is certified that error appears in the above-identified patent and that said Letters Patent are hereby corrected as shown below:

Col. 1, line 31, insert --slag-- after "molten".

Col. 5, line 62, insert --15-- after "channel".

Col. 9, line 25, change "reset" to --rests--.

Col. 9, line 35, change "the" (second occurrence) to --a--.

Col. 9, line 36, change "seconding" to --secondary--.

Col. 9, line 63, insert --the-- before "time".

Col. 9, line 63, insert --that-- after "time".

Col. 13, line 22, change "Ifthe" to --If the--.

Col. 13, lines 60 & 61, change "essentially" to --especially--.

Claim 8, line 3, change "lesat" to --least--.

Signed and Sealed this

Twentieth Day of July 1976

[SEAL]

*Attest:*

RUTH C. MASON
*Attesting Officer*

C. MARSHALL DANN
*Commissioner of Patents and Trademarks*